US005476557A

United States Patent [19]

Cox

[11] Patent Number: 5,476,557

[45] Date of Patent: Dec. 19, 1995

[54] MATCH HEAD FORMULATIONS

[75] Inventor: Michael G. C. Cox, Kingsley, England

[73] Assignee: Bryant & May Ltd., Buckinghamshire, England

[21] Appl. No.: 28,260

[22] Filed: Mar. 9, 1993

Related U.S. Application Data

[62] Division of Ser. No. 817,936, Jan. 8, 1992, abandoned.

[30] Foreign Application Priority Data

Jan. 8, 1991 [GB] United Kingdom ..... 9100308

[51] Int. Cl.[6] ..... C06B 39/02

[52] U.S. Cl. ..... 149/31

[58] Field of Search ..... 149/31

[56] References Cited

U.S. PATENT DOCUMENTS

| | | | |
|---|---|---|---|
| 125,874 | 4/1872 | Zaiss | 149/31 |
| 149,324 | 4/1874 | Meyer | 149/31 |
| 1,406,176 | 2/1922 | Fairburn | 149/85 |
| 1,980,910 | 11/1934 | Clauser | 149/32 |
| 2,193,124 | 3/1940 | Doran | 149/85 |
| 3,775,198 | 11/1973 | Hirikata | 149/18 |
| 4,060,434 | 11/1977 | Lanham et al. | 149/19.1 |
| 4,540,419 | 9/1985 | Lanham et al. | 149/85 |
| 5,009,729 | 4/1991 | Radkowski | 149/109.4 |

OTHER PUBLICATIONS

Finch et al., "Matchmaking: Science Technology and Manufacturer", pp. 19–26, Ellis Horwood (John Wiley & Sons) (1983) New York.

*Primary Examiner*—Edward A. Miller
*Attorney, Agent, or Firm*—Herbert Dubno; Jonathan Myers

[57] ABSTRACT

Match head formulations suitable for the production of safety matches and matches that may be struck anywhere are described in which chromium compounds, sesqui-based phosphorus compounds, sulphur compounds and oxides of zinc are absent. In their place is described the use of either amorphous phosphorus or, in the case of match head formulations suitable for the production of safety matches, an iron phosphade known as ferrophosphorus. These formulations are environmentally friendly both in manufacture and use. Environmentally friendly match head formulations which may be brightly colored are also described.

14 Claims, No Drawings

MATCH HEAD FORMULATIONS

This is a divisional of application Ser. No. 07/817,936 filed on Jan. 8, 1992, now abandoned.

FIELD OF THE INVENTION

The present invention relates to match head formulations suitable for the production of safety matches as well as matches that may be struck anywhere and to matches when coated with the said formulations.

BACKGROUND OF THE INVENTION

For many years match head formulations have contained chromium compounds, phosphorus sesquisulphide, sulphur and/or sulphur compounds and zinc oxide. These compounds are now widely recognised as having undesirable environmental properties both in relation to the manufacture of such formulations and in relation to their use and it is therefore an object of the present invention to provide a match head formulation in which these compounds are substantially absent.

One type of match in common use has a match head formulation which is ignited by an abrasive contact with any suitable roughened surface. These are referred to as 'strike anywhere' matches. A second type of match in common use has a match head formulation which is ignited by an abrasive contact with a surface containing a formulation for initiating ignition of the match head. These are referred to as 'safety matches'.

SUMMARY OF THE INVENTION

According to a first aspect of the present invention there is provided a match head formulation suitable for the production of strike anywhere matches containing potassium chlorate and red amorphous phosphorus, the balance comprising a binder, a thickener, a filler, and a foaming agent to the exclusion of phosphorus sesquisulphide.

In a preferred embodiment of this first aspect of the present invention the density of the formulation when in the form of a wet composition is in a range from 1.1 to 1.4 g/cm$^3$. Preferably the proportion of potassium chlorate present is in the range from 40 to 60 percent dry weight while the red amorphous phosphorus is present in a proportion of up to 9 percent dry weight. Gelatine may provide a suitable binder if present in proportions ranging from 8 to 18 percent dry weight or alternatively the binder may be in the form of animal glue. The thickener is preferably a starch present in proportions of up to 4 percent dry weight while felspar or other silicaceous minerals may be chosen as the filler. The formulation may also include an ash improver, a pigment and a bleaching agent.

According to a second aspect of the present invention there is provided a match head formulation suitable for the production of safety matches containing a potassium chlorate and red amorphous phosphorus, the balance being made up of a binder, a thickener, a filler, and a foaming agent to the exclusion of sulphur, zinc oxide and a dichromate.

In a preferred embodiment of this second aspect of the present invention the density of the formulation when in the form of a wet composition is in the range from 1.0 to 1.4 g/cm$^3$. Preferably the proportion of potassium chlorate present is in the range from 40 to 60 percent dry weight while the amorphous phosphorus is present in proportions ranging from 0.5 to 2.0 percent dry weight —too little and the match is hesitant while too much and the match is able to be struck anywhere. Again gelatine may provide a suitable binder if present in proportions ranging from 3 to 12 percent dry weight or alternatively the binder may be in the form of animal glue. The thickener is preferably a starch present in proportions of up to 5 percent dry weight while the foaming agent may be Arylan PWS, an amine salt of an alkyl aryl sulphonic acid present in proportions of up to 0.2 percent dry weight. As before, felspar may be chosen as the filler. The formulation may also include an ash improver such as infusoria in proportions of up to 6 percent dry weight or a cellulose flour such as olivestone flour in proportions of up to 7 percent dry weight and a pigment such as iron oxide in proportions ranging from 3 to 10 percent dry weight. In formulations not containing iron oxide, potassium hexacyanoferrate II or potassium hexacyanoferrate III may be included as a sensitizer and ash improver each in proportions of up to 7 percent dry weight.

According to a third aspect of the present invention there is provided a pyrotechnic composition including ferrophosphorus (a mixture of iron phosphides containing typically between 18 and 25 percent phosphorus).

In a preferred embodiment of this third aspect of the present invention the pyrotechnic composition is a match head formulation containing potassium chlorate. The balance may be made up of a binder, a thickener, a filler, and a foaming agent to the exclusion of sulphur, zinc oxide or a dichromate. The proportion of potassium chlorate present may be in the range from 40 to 60 percent dry weight while the ferrophosphorus may be present in proportions in excess of 5 percent dry weight. Once more gelatine may provide a suitable binder if present in proportions ranging from 3 to 12 percent dry weight or alternatively the binder may be in the form of animal glue. The thickener is preferably a starch present in proportions of up to 10 percent dry weight while felspar may again be chosen as the filler. The formulation may also contain a pigment and in particular may contain iron oxide in proportions of up to 10 percent dry weight.

Some examples of the present invention will now be described with reference to formulations suitable for the production of safety matches and strike anywhere matches.

Strike Anywhere Matches

In the past match head formulations suitable for the production of strike anywhere matches have contained phosphorus sesquisulphide compounds as the active ingredient. In the first example phosphorus sesquisulphide is no longer present in the formulation and is replaced by red amorphous phosphorus.

EXAMPLE 1

A match head formulation suitable for the production of strike anywhere matches is prepared in which 48.34 percent dry weight of potassium chlorate is mixed with 12.43 percent dry weight of gelatine, 2.76 percent dry weight of starch, 20.72 percent dry weight of felspar, 0.35 percent dry weight of Eosin, 2.76 percent dry weight of titanium dioxide, 6.90 percent dry weight of limestone, and 0.21 percent dry weight of sodium dithionite ensuring good wetting and dispersion of all the ingredients before adding 5.52 percent dry weight of red amorphous phosphorus as an aqueous slurry.

The above formulation combines a satisfactory sensitivity and bum rate and has no propensity to produce burning fragments or dropping of hot ash. The formulation also provides cost benefits over other existing formulations.

The water content of the above formulation may be in the range from 40 to 50 g per 100 g of solids but is typically 45.6 g/100 g solids.

The density of the formulation when in the form of a wet composition may be in the range of 1.1 to 1.4 g/cm$^3$ but is typically 1.25 g/cm$^3$. This figure is lower than is usual for match head formulations of this type as a result of being more highly aerated and contributes towards an improved sensitivity and a faster drying rate. The formulation is thus able to dry even during freak spells of high atmospheric humidity.

The proportions of potassium chlorate present may range from 40 to 60 percent dry weight while the red amorphous phosphorus may be present in proportions of up to 7 percent dry weight for the formulation to maintain a satisfactory performance.

The gelatine is present as a binder. The binder content of the formulation is lower than is usual and consequently improves the sensitivity of the formulation as well as the drying rate. The gelatine may be present in proportions ranging from 8 to 18 percent dry weight without adversely affecting the sensitivity. In place of gelatine animal glue may provide a satisfactory binding agent.

Starch is present as a thickener to improve the head formulation during drying and may be present in proportions ranging from 1 to 4 percent dry weight and still serve its function satisfactorily.

The presence of amorphous phosphorus makes it difficult to achieve the clear bright colors characteristic of match head formulations based on phosphorus sesquisulphide. The muddy color of amorphous phosphorus in the above formulation is particularly difficult to mask in the orange/yellow spectral region and consequently a pigment such as Eosin may be required to be present in proportions of up to 7 percent dry weight. An alternative pigment to produce a match head formulation in the blue/red spectral region such as Rhodamine may not need to be present to such an extent. To assist the coloring of the formulation sodium dithionite may be used to bleach the gelatine while titanium dioxide may be employed as a masking agent. The titanium dioxide may be present in proportions of up to 7 percent dry weight.

Limestone may be present in proportions ranging from 3 to 14 percent dry weight to control the pH of the formulation while felspar is used as a filler and serves to make up the balance of the formulation.

It is to be noted that the above formulation is free of phosphorus sesquisulphide, zinc oxide and dichromates. The absence of sulphur from the formulation reduces the smell produced on striking a match coated with the formulation. The absence of phosphorus sesquisulphidc is advantageous because it is difficult to handle during manufacture.

Safety Matches

In the past match head formulations suitable for the production of safety matches have contained chromium compounds, sulphur compounds and zinc oxide and in particular have contained potassium dichromate, sulphur powder and zinc oxide. In the second example all these are absent from the formulation and have been replaced by red amorphous phosphorus.

EXAMPLE 2

A match head formulation suitable for the production of safety matches is prepared in which 54.18 percent dry weight of potassium chlorate is mixed with 4.06 percent dry weight of gelatine, 4.06 percent dry weight of starch, 20.32 percent dry weight of felspar, 2.7 1 percent dry weight of infusoria, 6.77 percent dry weight of iron oxide, 0.09 percent dry weight Of Arylan PWS, and 6.77 percent dry weight of limestone ensuring good wetting and dispersion of all the ingredients before adding 1.03 percent dry weight of amorphous phosphorus as an aqueous slurry.

The water content of the above formulation may be in the range of 40 to 55 g per 100 g of solids but is typically 48.8 g/100 g solids.

The density of the formulation when in the form of a wet composition may be in the range from 1.0 to 1.4 g/cm$^3$ but is typically 1.15 g/cm$^3$. As in Example 1 this figure is lower than is usual for match head formulations of this type as a result of being more highly aerated and contributes towards an improved sensitivity and a faster drying rate.

It was found that the proportion of potassium chlorate present may range from 40 to 60 percent dry weight and the proportion of amorphous phosphorus may range from 0.5 to 2.0 percent dry weight for the formulation to maintain a satisfactory performance.

The gelatine is present as a binder. As in Example 1 the binder content of the formulation is lower than is usual and consequently improves the sensitivity of the formulation as well as the drying rate. Gelatine may be present in proportions ranging from 3 to 12 percent dry weight without adversely affecting the sensitivity. In place of gelatine animal glue may provide a satisfactory binding agent.

Starch is present as a thickener to improve the head formation during drying and constitutes a major component of the binder system. In order to serve this function satisfactorily the starch may be present in proportions ranging from 0.5 to 5.0 percent dry weight.

Infusoria acts as an ash improver to prevent the head of the match from falling after use and may be present in proportions of up to 6 percent dry weight while Arylan PWS is a foaming agent which entrains air to control the thermal conductivity of the formulation and hence its sensitivity. Arylan PWS may be present in the formulation in proportions of up to 0.2 percent dry weight.

Again the presence of amorphous phosphorus makes it difficult to achieve clear bright colors but does not hinder the production of standard brown formulations. To this end iron oxide is used as a pigment and may be present in proportions ranging from 3 to 10 percent dry weight.

As in Example 1 limestone may be present in proportions ranging from 3 to 14 percent dry weight while felspar is used as a filler and serves to make up the balance of the formulation.

It is to be noted that the above formulation is free of potassium dichromate, sulphur and zinc oxide. The absence of sulphur from the formulation reduces the smell produced on striking a match coated with the formulation. The absence of potassium dichromate is advantageous because potassium dichromate is difficult to handle during manufacture.

The above formulation combines a satisfactory sensitivity and burn rate and has no propensity to produce burning fragments or dropping of hot ash. The formulation meets all the requirements of BS3795 and provides cost benefits over other existing formulations.

EXAMPLE 3

In order to achieve a more brightly colored match head formulation suitable for the production of safety matches and having properties similar to those described with reference to Example 2 above 55.52 percent dry weight of potassium chlorate is mixed with 4.16 percent dry weight gelatine, 4.16 percent dry weight of starch, 13.88 percent dry weight of felspar, 5.55 percent dry weight of infusoria, 0.09 percent dry weight of Arylan PWS, 6.94 percent dry weight of limestone, 6.94 percent dry weight of olivestone flour, up to 7.0 percent dry weight of a chosen pigment, and 1.39 percent dry weight of titanium dioxide ensuring good wetting and dispersion of all the ingredients before adding 1.05 percent dry weight of amorphous phosphorus as an aqueous slurry.

This formulation is similar to that described in Example 2 above and differs essentially only in that it may be more brightly colored. Consequently the proportions of the chlorate, amorphous phosphorus, gelatine, starch, infusoria, Arylan PWS, limestone, and felspar may vary within substantially the same ranges as disclosed in Example 2. Of the constituents not found in that Example olivestone flour acts as an ash improver and may be present in proportions of up to 7 percent dry weight while titanium dioxide may also be present in proportions of up to 7 percent dry weight and acts as a masking agent as described in Example 1. Olivestone flour may be substituted by other cellulose flours.

Potassium hexacyanoferrate II and potassium hexacyanoferrate III may be included in the above formulation each in proportions of up to 7 percent dry weight in order to provide a sensitizer system in place of a dichromate. Potassium hexacyanoferrate II and potassium hexacyanoferrate III also act as an ash improver.

EXAMPLE 4

The amorphous phosphorus of the formulations described in Examples 2 and 3 may be replaced by ferrophosphoms, a mixture of iron phosphides containing typically between 18 and 25 percent phosphorus. Ferrophosphoms is relatively inexpensive and easy to handle but is a dense black powder and therefore limits the range of colors attainable.

A match head formulation of this type suitable for the production of safety matches is provided by mixing 52.63 percent dry weight of potassium chlorate with 3.95 percent dry weight of gelatine, 3.95 percent dry weight of starch, 19.73 percent dry weight of felspar, 6.57 percent dry weight of iron oxide and 13.16 percent dry weight of ferrophosphorus. The ferrophosphorus is preferably ground to a particle size of up to 100 microns.

It is to be noted that with a particle size between 20 and 65 microns it is possible to produce a composition with a color other than black by using dyes. Ferrophosphoms in this range of particle size has been found to be beneficial in a range of pyrotecnic applications.

While it was found that the proportion of potassium chlorate present may range from 40 to 60 percent dry weight the proportion of ferrophosphorus was required to exceed 5 percent dry weight in order to maintain a satisfactory performance.

The proportion of gelatine present in the formulation was found to be able to range from 3 to 12 percent dry weight while the starch could be present in proportions of up to 10 percent dry weight. As in previous examples felspar is used as a filler and serves to make up the balance of the formulation.

If despite the nature of ferrophosphorus a more brightly colored formulation is required the iron oxide may be omitted and replaced by titanium dioxide and a suitable pigment each in proportions of up to 7 percent dry weight.

What is claimed is:

1. A match head formulation suitable for the production of safety matches containing potassium chlorate and red amorphous phosphorous, the balance being made up of a binder, a thickener, a filler, and a foaming agent to the exclusion of sulphur, zinc oxide and a dichromate wherein the proportion of amorphous phosphorus present is in the range from 0.5 to 2.0 percent dry weight.

2. A match head formulation in accordance with claim 1 which when in the form of a wet composition has a density in the range from 1.0 to 1.4 g/cm$^3$.

3. A match head formulation in accordance with claim 1 wherein the proportion of potassium chlorate present is in the range from 40 to 60 percent dry weight.

4. A match head formulation in accordance with claim 1 wherein the binder is gelatine and is present in proportions ranging from 3 to 12 percent dry weight.

5. A match head formulation in accordance with claim 1 wherein the binder is animal glue.

6. A match head formulation in accordance with claim 1 wherein the thickener is a starch and is present in proportions of up to 5 percent dry weight.

7. A match head formulation in accordance with claim 1 wherein the foaming agent is Arylan PWS and is present in proportions of up to 0.2 percent dry weight.

8. A match head formulation in accordance with claim 1 wherein the filler is felspar or another silicaceous mineral.

9. A match head formulation in accordance with claim 1 wherein the formulation also contains an ash improver.

10. A match head formulation in accordance with claim 9 wherein the ash improver is infusoria and is present in proportions of up to 6 percent dry weight.

11. A match head formulation in accordance with claim 9 wherein the ash improver is a cellulose flour such as olivestone flour and is present in proportions of up to 7 percent dry weight.

12. A match head formulation in accordance with claim 1 wherein the formulation also contains a pigment.

13. A match head formulation in accordance with claim 12 wherein the pigment is iron oxide and is present in proportions ranging from 3 to 10 percent dry weight.

14. A match head formulation in accordance with claim 1 wherein the formulation also contains potassium hexacyanoferrate II and potassium hexacyanoferrate III as a sensitizer or ash improver, each in proportions of up to 7 percent dry weight.

* * * * *